United States Patent [19]

Eriksson

[11] 4,359,136

[45] Nov. 16, 1982

[54] MUFFLER CONSTRUCTION

[75] Inventor: Larry J. Eriksson, Madison, Wis.

[73] Assignee: Nelson Industries Inc., Stoughton, Wis.

[21] Appl. No.: 157,494

[22] Filed: Jun. 9, 1980

[51] Int. Cl.[3] ..... G03B 1/08

[52] U.S. Cl. ..... 181/269

[58] Field of Search ..... 181/247, 249, 255, 269, 181/243, 282–283

[56] References Cited

U.S. PATENT DOCUMENTS

| | | | |
|---|---|---|---|
| 1,360,311 | 11/1920 | Padgett | 181/243 |
| 3,386,529 | 6/1968 | Pannone | 181/243 |
| 3,442,124 | 5/1969 | Warren et al. | 235/201 PF |
| 3,958,660 | 5/1976 | Boor | 181/269 |

FOREIGN PATENT DOCUMENTS

| | | | |
|---|---|---|---|
| 46-32374 | 9/1971 | Japan | 181/265 |

OTHER PUBLICATIONS

"Higher Order Mode Effects in Circular Ducts and Expansion Chambers," *J. Acoustical Soc. of America* 68(2), Aug. 1980, pp. 545–550, L. J. Eriksson.

*Primary Examiner*—L. T. Hix
*Assistant Examiner*—Thomas H. Tarcza
*Attorney, Agent, or Firm*—Andrus, Sceales, Starke & Sawall

[57] ABSTRACT

A muffler construction comprising an outer body, and a pair of end walls extend transversely across the body to define an internal chamber. An inlet conduit is located in one of the end walls, while an outlet conduit is in the other end wall. In one embodiment, the inlet conduit is disposed axially of the body to excite symmetric higher order modes and the outlet is offset radially from the axis of the body and is located on a nodal circle of the transverse pressure distribution. In a second embodiment, the inlet is offset from the axis of the body causing excitation of asymmetric higher order modes and the outlet is located on a nodal line of the transverse pressure distribution. The construction of the invention maximizes attenuation of high order modes in mufflers.

6 Claims, 10 Drawing Figures

INSERTION LOSS, DECIBELS

FREQUENCY – HERTZ

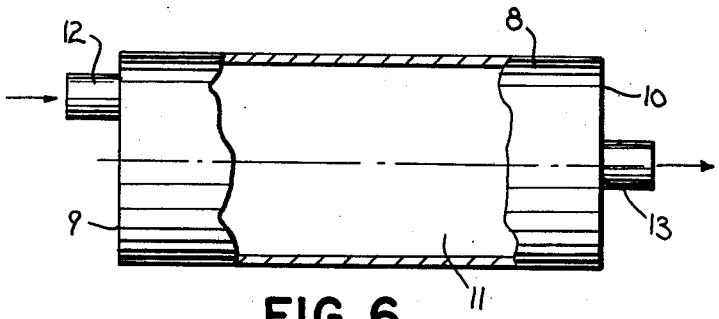
FIG. 6
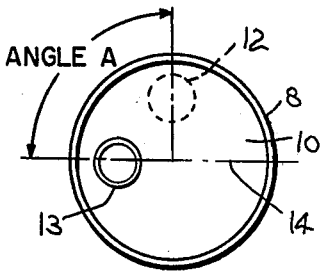
FIG. 7
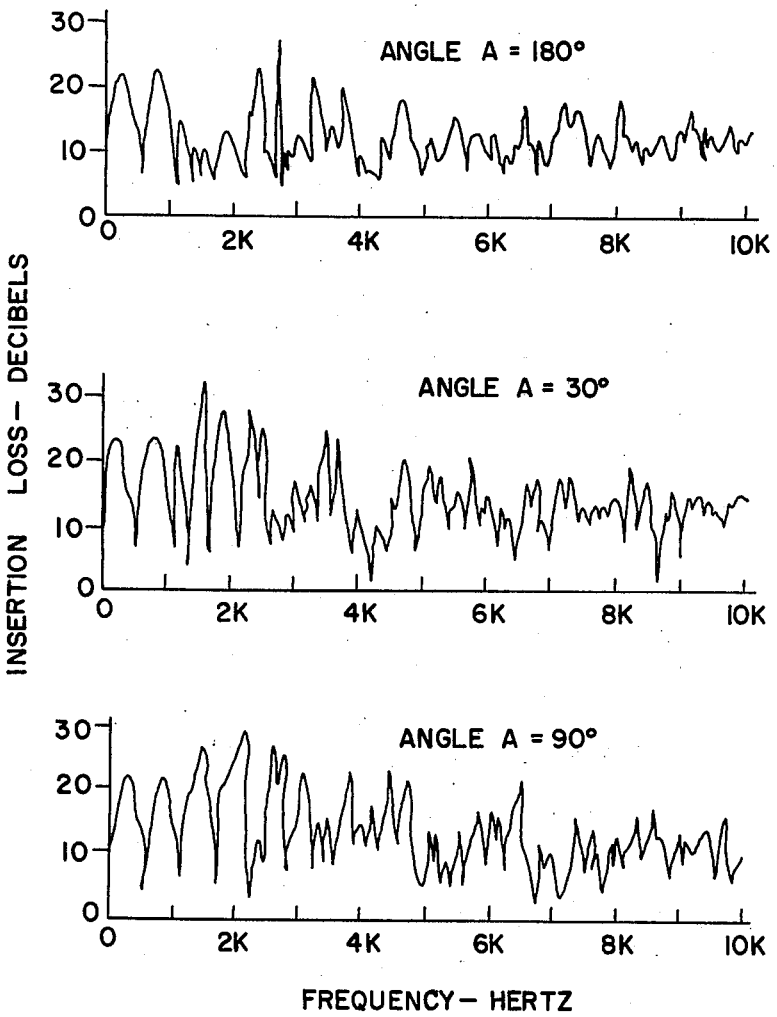
FIG. 8
FIG. 9
FIG. 10

MUFFLER CONSTRUCTION

BACKGROUND OF THE INVENTION

Traditional muffler designs have paid little attention to the importance of the inlet and outlet locations relative to obtaining maximum attenuation from a given muffler volume. In the past, two standard approaches have typically been used. In the first, the inlet and outlet have been axially aligned as in a straight-through expansion chamber, a plug section or a resonator. The second approach has been to offset both the inlet and outlet along a diameter of the muffler body, as used in a so-called "pass-type" muffler. However, the positioning of the inlet and outlet has been primarily for convenience of construction and adaptation to engines, as opposed to obtaining maximum sound attenuation.

SUMMARY OF THE INVENTION

The invention is directed to an improved muffler construction which positions the inlet and outlet at precise locations to obtain maximum sound attenuation. In accordance with the invention, the muffler includes an outer body and a pair of spaced end walls or baffles extend across the body and define the internal unobstructed chamber. An inlet conduit is mounted in one of the end walls, while an outlet conduit is mounted in the other end wall.

In one embodiment of the invention, the inlet conduit is disposed axially of the muffler body, thereby causing excitation of symmetric higher order modes, and the outlet conduit is offset from the axis of the body and is located on a pressure nodal circle of the mode to be attenuated.

In a second embodiment of the invention, the inlet conduit is offset from the axis of the muffler body, resulting in excitation of asymmetric higher order modes. In this situation, the outlet conduit in the opposite end wall is positioned on a pressure nodal line of the mode to be attenuated.

The construction of the invention, by precisely locating the inlet and outlet, achieves substantially greater sound attenuation from a given muffler volume than that of prior art muffler configurations.

Other objects and advantages will appear in the course of the following description.

DESCRIPTION OF THE DRAWINGS

The drawings illustrate the best mode presently contemplated of carrying out the invention.

In the drawings:

FIG. 6 is a side elevation with parts broken away of a modified form of the invention;

FIG. 7 is an end view of the muffler construction shown in FIG. 6;

FIG. 8 is a graph plotting insertion loss against frequency for an expansion chamber in which the inlet and outlet are offset from the axis of the chamber and the outlet is displaced 180° from the inlet;

FIG. 9 is a graph plotting insertion loss against frequency for an expansion chamber in which the inlet and outlet are offset from the axis of the chamber and the outlet is displaced 30° from the inlet; and FIG. 10 is a graph plotting insertion loss against frequency for an expansion chamber in which the inlet and outlet are offset from the axis of the chamber and the outlet is displaced 90° from the inlet and is located on the nodal line of the first asymmetric higher order mode.

DESCRIPTION OF THE PREFERRED EMBODIMENT

Figure 1:
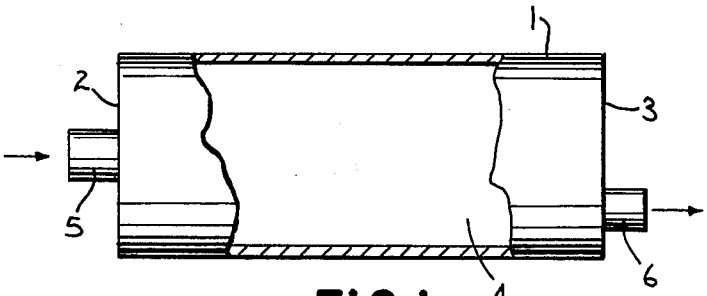
FIG. 1 is a side elevation with parts broken away of a muffler constructed in accordance with the invention.
Figure 2:
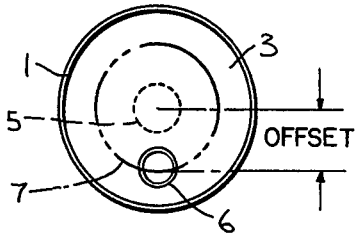
FIG. 2 is an end view of the muffler shown in FIG. 1.

FIGS. 1 and 2 show a muffler constructed in accordance with the invention. The muffler comprises a generally cylindrical outer body 1 or shell, the ends of which are closed off by baffles or end walls 2 and 3. The space defined by the body 1 and baffles 2 and 3 constricts an internal chamber 4, which is free of obstructions, such as baffles, flanges, and the like. The exhaust gas is introduced into the chamber 4 through an inlet pipe 5, which is mounted within an opening in the baffle 2, and is connected to the engine exhaust. The gas is discharged from the chamber 4 through a pipe 6 which is mounted within an opening in the baffle 3.

In accordance with the invention, the inlet pipe 5 and outlet pipe 6 are positioned at precise locations with respect to each other to obtain maximum sound attenuation. As best shown in FIG. 2, the inlet pipe 5 is mounted axially of the body, while the outlet pipe 6 is offset radially from the axis of the body and is located on a pressure nodal circle of the symmetric higher order mode to be attenuated.

The basic propagating mode in a cylindrical muffler body is a plane wave mode in which there is essentially uniform pressure across the entire cross section of the body. Above certain frequencies, there are a number of different possible modes or pressure distributions and each mode has its own cut-off frequency which is determined by the diameter of the body and the sound velocity. With an axial inlet pipe, as shown in FIGS. 1 and 2, the higher order modes will be symmetric. On the other hand, if the inlet pipe is not mounted coaxially of the body, the higher order modes will be a symmetric.

According to the construction, as shown in FIGS. 1 and 2, the attenuation is maximized by off-setting the outlet pipe 6, so that it lies on a pressure nodal circle, indicated by 7, of a symmetric higher order mode. The position of the nodal circle for a given size muffler body and mode can be calculated from information set forth in "Higher Order Mode Effects In Circular Ducts and Expansion Chambers", L. J. Eriksson, presented at the 97th Meeting of the Accoustical Society of America, June 11–15, 1979.

The pressure distribution in a circular body is proportional to $J_m(x)$ where $J_m$ is the Bessel Function of the first kind of order m and x is proportional to the radius. At a nodal circle, the pressure must go to zero or $J_m(x)=0$. At the wall of the body, the radial velocity which is proportional to the derivative of the pressure in the radial direction must go to zero or $J'_m(x)=0$. Thus, the location of a nodal circle of a higher order mode in a circular body may be calculated from the product of the muffler body radius and the ratio of the zero of the equation $J_m(x)=0$ to the zero of the equation $J'_m(x)=0$ for the nodal circle and mode under consideration. For example, for a 6" diameter body, the nodal circle for the first symmetric mode occurs at a radius of:

$$3''\times(2.40/3.83)=1.88''\approx 2''$$

since $J_o(2.40)=0$ and $J'_o(3.83)=0$.

Figure 3:
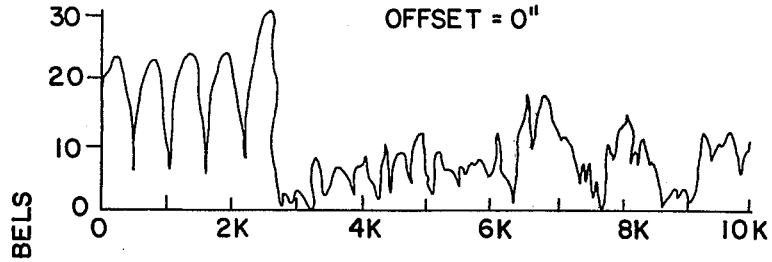
FIG. 3 is a graph plotting insertion loss against frequency for an expansion chamber in which the inlet and outlet are co-axial.
Figure 4:
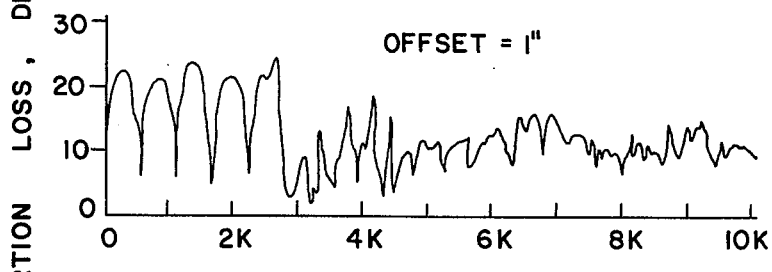
FIG. 4 is a graph plotting insertion loss against frequency for an expansion chamber in which the inlet is axial and the outlet is offset from the axis of the chamber.
Figure 5:
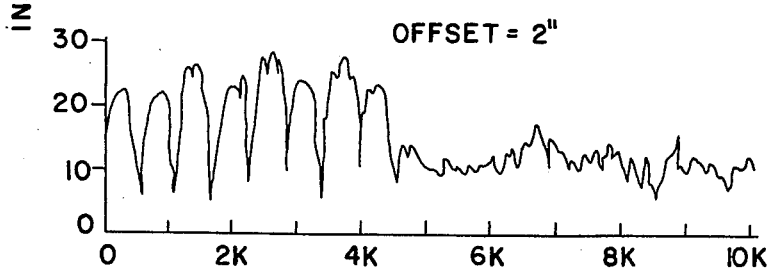
FIG. 5 is a graph plotting insertion loss against frequency for an expansion chamber in which the inlet is axial and the outlet is offset from the axis of the chamber and is located on the nodal circle of the first symmetric higher order mode.

FIGS. 3–5 illustrate the improvement in sound attenuation which is achieved by offsetting the outlet pipe from the axis of the muffler body and locating the outlet on a pressure nodal circle of the higher wave mode. In FIG. 3, the insertion loss spectrum (attenuation) in decibels (dB) has been plotted for an expansion chamber (6" dia., 12" length) with an axially centered inlet and outlet. Below about 2800 Hz, the usual expansion chamber behavior is clearly in evidence, with the maximum sound attenuation being about 20–30 dB. The minimum sound attenuation occurs when the length of the chamber equals a multiple of a half wave length, and maximum attenuation occurs when the length of the chamber equals an odd multiple of a quarter wave length. At about 2800 Hz, the first radial or symmetric higher order mode is strongly excited in this system and, as shown in FIG. 3, the attenuation is dramatically reduced in this frequency range. The overall attenuation with this configuration on a broad band noise source was found to be about 13.0 dB.

In FIG. 4, the insertion loss spectrum has been plotted for an expansion chamber of the same overall dimensions, but an axial inlet and an outlet offset 1" from the axis. As illustrated in FIG. 4, beginning at about 2800 Hz, an improvement in attenuation is shown over that of FIG. 3, in which both the inlet and outlet were coaxial.

In FIG. 5, the insertion loss spectrum has been plotted for an expansion chamber of the same dimensions in which the inlet is axial and the outlet is offset 2" from the axis of the body and intersects the pressure nodal circle of the first radial or symmetric mode. This configuration resulted in substantially greater attenuation from about 2800 Hz to about 4500 Hz and resulted in overall attenuation on a broad band noise source of 14.0 dB, thereby illustrating the improvement in sound attenuation which can be achieved by offsetting the outlet from the axis of the body and positioning the outlet on a pressure nodal circle of the higher order wave mode. In addition, the dramatic improvement of about 20–30 dB between 2800–4500 Hz can be very useful on noise control problems in this frequency range.

FIGS. 6 and 7 illustrate another form of the invention and show a muffler comprising a generally cylindrical outer body 8, the open ends of which are enclosed by baffles or end walls 9 and 10, similar to baffles 2 and 3. The internal space or chamber 11 is free of obstructions, such as baffles, flanges and the like.

The exhaust gas is introduced into the chamber 11 through an inlet pipe 12 which is mounted within an opening in the baffle 9, while the gas is discharged from the chamber 11 through a pipe 13 that is secured within openings in the baffle 10.

In accordance with the construction shown in FIGS. 6 and 7, the inlet pipe 12 is offset from the axis of the body 8, causing excitation of the first asymmetric higher order mode above 1300 Hz, and the outlet pipe 13 is preferably offset from the axis of the body and is located on the pressure nodal line, indicated by 14, of the first asymmetric higher order mode, which line is located on a radius normal or perpendicular to the radius on which the inlet pipe 12 is located. As the inlet pipe is offset from the axis, symmetric higher order modes will tend to not be excited, but by placing the outlet 13 on the pressure nodal line 14, as well as on the pressure nodal circle of the first symmetric wave mode, the construction will also minimize any reduction in attenuation caused by the excitation of the first symmetric mode.

FIGS. 8–10 illustrate the improvement in sound attenuation for higher order asymmetric modes through the construction of the invention. In FIG. 8, the insertion loss spectrum in decibels is plotted against the frequency for an expansion chamber (6" dia., 12" length) with the inlet pipe being offset 2" from the axis of the body and the outlet pipe also offset 2" from the axis, and displaced 180° with respect to the inlet. At about 1300 Hz, the first asymmetric mode is strongly excited in this chamber and, as shown in FIG. 8, the attenuation is dramatically reduced in this frequency range. The overall attenuation of the configuration of FIG. 8 on a broad band noise source was found to be about 11.5 dB.

FIG. 9 is similar to FIG. 8, except that the outlet is displaced 30° from the inlet. In this case an overall insertion loss or attenuation of 12.5 dB was achieved.

FIG. 10 is similar to that of FIGS. 8 and 9, except that the outlet was displaced 90° from the inlet. This configuration substantially improved the attenuation resulting in a 14 dB overall insertion loss. The results of FIGS. 8–10 illustrates the dramatic improvement in sound attenuation which can be achieved when using a non-axial inlet and displacing the outlet on a radius 90° with respect to the radius on which the inlet is located. As before, the dramatic improvement of up to 20–30 dB between about 1300–4500 Hz can be very useful on noise control problems in this frequency range.

In addition to the above description of the placement of the outlet on the pressure nodal line of the first asymmetric mode, it is also contemplated that the construction can be used to maximize attenuation of other asymmetric modes by locating the outlet on a pressure nodal circle of an asymmetric mode calculated as shown previously or on a pressure nodal line for asymmetric modes with more than one pressure nodal line (m greater than one).

While the above description has illustrated the invention as used with a muffler for an exhaust system of an internal combustion engine, it is contemplated that the construction can also be used for various other types of silencers or mufflers. Similarly, the invention has application for use with any chamber within a multi-chambered muffler, as well as in connection with a single chamber muffler.

Various modes of carrying out the invention are contemplated as being within the scope of the following claims particularly pointing out and distinctly claiming the subject matter which is regarded as the invention.

I claim:

1. A device for attenuating sound energy, comprising an outer body, a pair of transverse walls extending across said body and defining an internal chamber, said chamber being free of internal obstructions, an inlet conduit disposed in one of said walls for introducing gas into said chamber, an outlet conduit disposed in the other of said walls for discharging gas from said chamber, one of said conduits being offset from the axis of said body on a first radius and the other of said conduits being positioned along a diameter disposed at an angle of 90° to said first radius, said outlet conduit beng located at a pressure nodal position of the first symmetric higher order mode of the chamber.

2. A device for attenuating sound energy, comprising an outer body, a pair of transverse walls extending across said body and defining an internal chamber, said chamber being free of internal obstructions, an inlet conduit disposed in one of said walls for introducing gas into said chamber, an outlet conduit disposed in the other of said walls for discharging gas from said chamber, said inlet conduit being disposed on the axis of said body and said outlet conduit being offset from said axis and disposed along a radius and located on a pressure nodal circle of the first symmetric higher order mode of the chamber.

3. A device for attenuating sound energy, comprising an outer body, a pair of transverse walls extending across said body and defining an internal chamber, said chamber being free of internal obstructions, one of said walls having an inlet for introducing gas into said chamber and the other of said walls having an outlet for discharging gas from said chamber, said inlet being offset from the axis of said body and disposed along a first radius, said outlet being offset from said axis and being disposed along a second radius displaced approximately 90° from said first radius.

4. The device of claim 3, wherein said inlet and outlet are located at approximately the same distance from the axis of said body.

5. The device of claim 4, wherein said inlet and outlet are located on a pressure nodal circle of the first symmetric higher order mode of the chamber.

6. The device or claim 5, wherein said inlet and outlet are located on the pressure nodal circle of the first symmetric higher order mode of the chamber.

* * * * *